US011137156B2

(12) United States Patent
Rite

(10) Patent No.: US 11,137,156 B2
(45) Date of Patent: Oct. 5, 2021

(54) REFRIGERANT CHARGE MANAGEMENT WITH SUBCOOLING CONTROL

(71) Applicant: Trane International Inc., Davidson, NC (US)

(72) Inventor: Raymond Walter Rite, Tyler, TX (US)

(73) Assignee: Trane International Inc, Davidson, NC (US)

( * ) Notice: Subject to any disclaimer, the term of this patent is extended or adjusted under 35 U.S.C. 154(b) by 174 days.

(21) Appl. No.: 16/428,297

(22) Filed: May 31, 2019

(65) Prior Publication Data

US 2020/0378640 A1 Dec. 3, 2020

(51) Int. Cl.

| | |
|---|---|
| ***F25B 30/02*** | (2006.01) |
| ***F25B 40/02*** | (2006.01) |
| ***F24F 1/06*** | (2011.01) |
| ***F24F 11/84*** | (2018.01) |
| ***F24F 11/30*** | (2018.01) |
| ***F24F 1/0007*** | (2019.01) |

(52) U.S. Cl.

CPC ..... *F24F 11/30* (2018.01); *F24F 1/0007* (2013.01); *F24F 1/06* (2013.01); *F24F 11/84* (2018.01); *F25B 30/02* (2013.01); *F25B 40/02* (2013.01); *F25B 2313/005* (2013.01); *F25B 2313/02731* (2013.01); *F25B 2313/0311* (2013.01); *F25B 2313/0315* (2013.01); *F25B 2600/2503* (2013.01); *F25B 2700/2104* (2013.01)

(58) Field of Classification Search

CPC ... F24F 11/30; F25B 30/02; F25B 5/02; F25B 2313/0314; F25B 13/00; F25B 2600/2513; F25B 2313/0313; F25B 2313/0312; F25D 11/022; F25D 11/003; F25D 17/06; B60H 1/34; B60H 1/323

See application file for complete search history.

(56) References Cited

U.S. PATENT DOCUMENTS

| | | | | |
|---|---|---|---|---|
| 4,045,977 | A | 9/1977 | Oliver, Jr. | |
| 4,484,452 | A | 11/1984 | Houser, Jr. | |
| 7,895,850 | B2 * | 3/2011 | Kitsch | F25B 47/006 62/176.6 |
| 2009/0301117 | A1 * | 12/2009 | Setoguchi | F25B 9/008 62/208 |

(Continued)

OTHER PUBLICATIONS

Balderrama, Jose Luis; U.S. Appl. No. 16/436,233, filing Jun. 10, 2019; Title: Refrigerant Volume Control; 34 pages.

*Primary Examiner* — Ana M Vazquez

(74) *Attorney, Agent, or Firm* — Womble Bond Dickinson (US) LLP

(57) ABSTRACT

Embodiments relate generally to subcooling control of a heating, ventilation, and air conditioning (HVAC) system. An HVAC system may include a first electronic expansion valve (EEV) fluidly coupled to an indoor coil, wherein the first EEV is adjacent to the indoor coil. The HVAC system may also include a second EEV fluidly coupled to an outdoor coil, wherein the second EEV is adjacent to the outdoor coil. A system controller may be configured to control the first and second EEVs to control a flow of refrigerant to control subcooling (SC) produced by the HVAC system. The second EEV remains open during a cooling mode, and the first EEV modulates during the cooling mode. The second EEV modulates during a heating mode, and the first EEV remains open during the heating mode.

17 Claims, 6 Drawing Sheets

(56) References Cited

U.S. PATENT DOCUMENTS

| | | | | |
|---|---|---|---|---|
| 2015/0107290 | A1* | 4/2015 | Hatomura ..... | F25B 41/00<br>62/324.6 |
| 2017/0016659 | A1 | 1/2017 | Chen et al. | |
| 2017/0059219 | A1 | 3/2017 | Goel | |

* cited by examiner

REFRIGERANT CHARGE MANAGEMENT WITH SUBCOOLING CONTROL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In a heating, ventilation, and air conditioning (HVAC) system, an amount of refrigerant charge circulating through heat exchange coils of the HVAC system impacts operating efficiency and subcooling (SC). An incorrect refrigerant charge level may cause excessively low or high levels of SC, thereby negatively impacting efficiency of the HVAC system.

SUMMARY

In an embodiment, an HVAC system may include an outdoor coil, an indoor coil, and a switch over valve (SOV) that is in fluid communication with the indoor and outdoor coils, wherein the SOV directs a flow of refrigerant in a first direction during a cooling mode, and directs the flow of refrigerant in a second direction during a heating mode, wherein the first direction is opposite to the second direction. The HVAC system may further include a first electronic expansion valve (EEV) fluidly coupled to the indoor coil, wherein the first EEV is adjacent to the indoor coil. The HVAC system may further include a second EEV fluidly coupled to the outdoor coil, wherein the second EEV is adjacent to the outdoor coil. The HVAC system may further include a liquid conduit fluidly coupling the first and second EEVs, and a first set of pressure and temperature sensors in fluid communication with the liquid conduit, wherein the first set of pressure and temperature sensors are adjacent to the first EEV, wherein the first set of pressure and temperature sensors are upstream to the first EEV during the cooling mode and downstream to the first EEV during the heating mode. The HVAC system may further include a second set of pressure and temperature sensors in fluid communication with the liquid conduit, wherein the second set of pressure and temperature sensors are adjacent to the second EEV, wherein the second set of pressure and temperature sensors are upstream to the second EEV during the heating mode and downstream to the second EEV during the cooling mode. The HVAC system further includes a system controller configured to control the first and second EEVs to control a flow of refrigerant to control SC produced by the HVAC system based on temperature and pressure measurements, wherein the second EEV remains open during the cooling mode, and wherein the first EEV modulates during the cooling mode based on temperatures and pressures measured by the first set of pressure and temperature sensors. During the heating mode, the first EEV remains open and the second EEV modulates based on temperatures and pressures measured by the second set of pressure and temperature sensors.

In an embodiment, an HVAC system may include an outdoor coil, an indoor coil, and a switch over valve (SOV) in fluid communication with the indoor and outdoor coils, wherein the SOV directs a flow of refrigerant in a first direction during a cooling mode, and directs the flow of refrigerant in a second direction during a heating mode, wherein the first direction is opposite to the second direction. The HVAC system may further include a first electronic expansion valve (EEV) fluidly coupled to the indoor coil, wherein the first EEV is adjacent to the indoor coil; a second EEV fluidly coupled to the outdoor coil, wherein the second EEV is adjacent to the outdoor coil; a liquid conduit fluidly coupling the first and second EEVs; a compressor in fluid communication with the indoor and outdoor coils; and a suction line accumulator adjacent to the compressor and in fluid communication with the compressor, wherein the suction line accumulator is upstream of the compressor, wherein the suction line accumulator is configured to receive excess refrigerant from the indoor coil during the cooling mode, and is configured to receive excess refrigerant from the outdoor coil during the heating mode. The HVAC system further includes a system controller configured to control the first and second EEVs to control a flow of refrigerant to control SC produced by the HVAC system, wherein the second EEV remains open during the cooling mode, and wherein the first EEV modulates during the cooling mode; wherein the first EEV remains open during the heating mode and wherein the second EEV modulates during the heating mode.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

An overcharged HVAC system where excess refrigerant is stored in a condenser coil operates at high discharge pressures. Therefore, the HVAC system may not achieve the desired efficiency. An undercharged HVAC system may also suffer from poor performance due to low suction pressure upstream of the compressor.

Additionally, in an HVAC system including a heat pump, the heat pump may be properly charged in a cooling mode, but due to differences in internal volumes of an outdoor coil and an indoor coil, the SC may be higher or lower than desired when the heat pump is in a heating mode.

The present disclosure relates generally to systems and methods to control SC generated by a condenser of an HVAC system including a heat pump and/or an air conditioner. Specifically, systems and methods of the present disclosure employ techniques for controlling EEVs. Utilizing the amount of SC of liquid refrigerant upstream of an EEV as a control target, SC can be maintained at a desired value to optimize performance over a range of ambient conditions, capacity demands, and/or less than ideal refrigerant charge levels.

In certain embodiments, a heat pump may be fitted with multiple EEVs. For example, the heat pump may include two EEVs. An indoor EEV may be positioned on or adjacent to an indoor coil, and an outdoor EEV may be positioned on or adjacent to an outdoor coil. A system controller may modulate the EEVs based on a desired amount of SC at a liquid conduit of the HVAC system. The SC is based on properties of the specific refrigerant, as well as, a pressure and a temperature measurement of the refrigerant in the liquid conduit.

In a cooling mode, the indoor EEV is utilized to control a flow of the refrigerant into the indoor coil, and an outdoor EEV is fully open. In a heating mode, the outdoor EEV is utilized to control a flow of the refrigerant into the outdoor coil, and an indoor EEV is fully open. In order to prevent a compressor of the HVAC system from receiving excess amounts of liquid refrigerant due to an evaporator of the HVAC system operating such that no superheat is leaving an evaporator coil, a refrigerant accumulator (e.g., a suction line accumulator), such as a metal container, may be fluidly coupled to a suction conduit upstream of the compressor to provide storage for excess refrigerant. The present disclosure is not limiting of the size and type of accumulator, such as a suction line accumulator, and may be variously configured as will be understood by one having skill in the art. The suction line accumulator helps to prevent compressor damage from a sudden surge of liquid refrigerant that could enter the compressor from the suction line.

Figure 1:
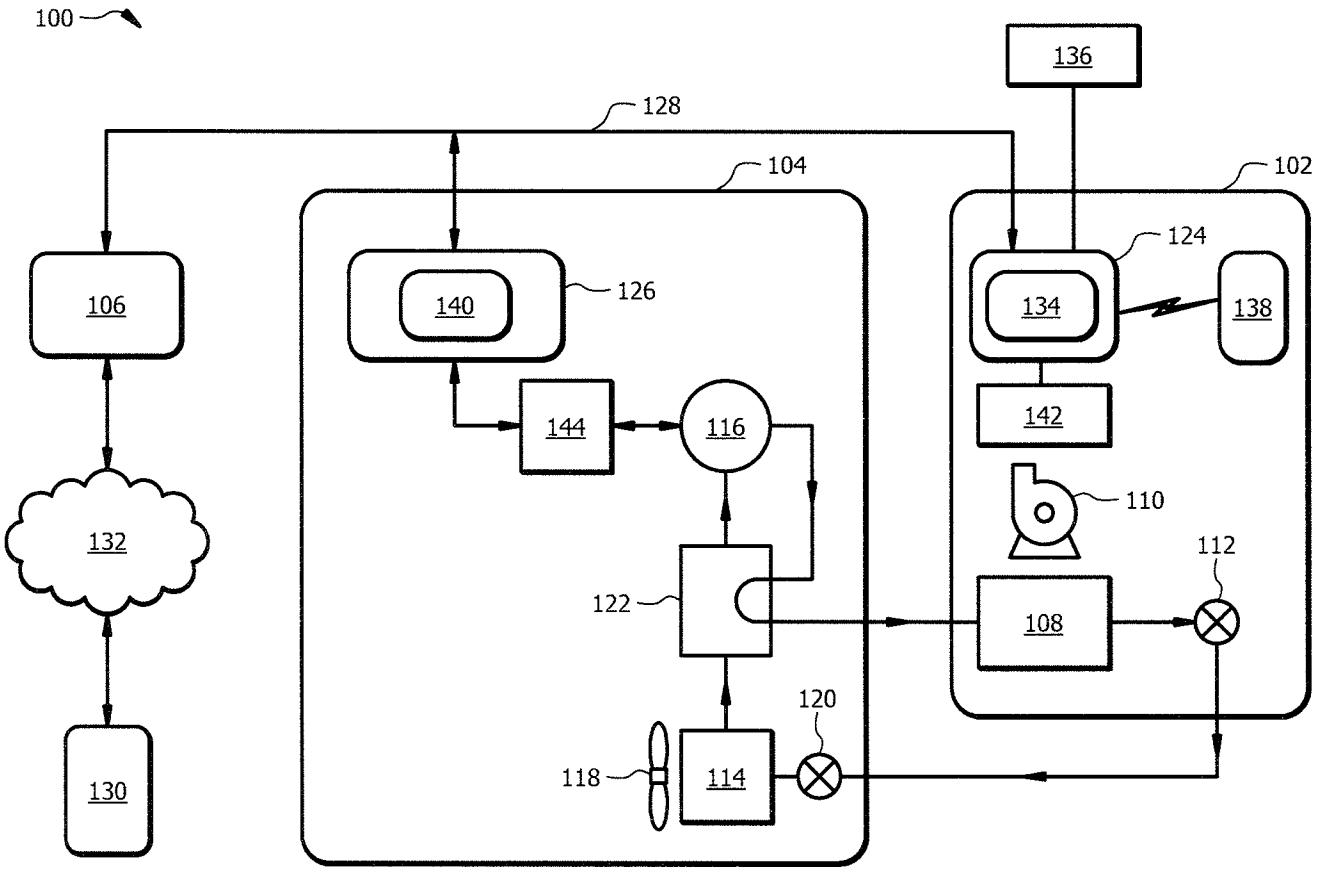
FIG. 1 illustrates a typical HVAC system.

Referring now to FIG. 1, a schematic diagram of a typical HVAC system 100 is shown. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of a climate controlled structure. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven EEV. In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, however, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the ambient outdoor temperature. Additionally, in some embodiments, the system controller 106 may comprise a temperature sensor and/or may further be configured to control heating and/or cooling of zones associated with the HVAC system 100. In other embodiments, however, the system controller 106 may be configured as a thermostat for controlling the supply of conditioned air to zones associated within the HVAC system 100.

The system controller 106 may also generally comprise an input/output (I/O) unit (e.g., a graphical user interface, a touchscreen interface, or the like) for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, however, the system controller 106 may not comprise a display and may derive all information from inputs from remote sensors and remote configuration tools.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

The HVAC system 100 is shown configured for operating in a so-called heating mode in which heat may generally be absorbed by refrigerant at the outdoor heat exchanger 114 and rejected from the refrigerant at the indoor heat exchanger 108. Starting at the compressor 116, the compressor 116 may be operated to compress refrigerant and pump the relatively high temperature and high pressure compressed refrigerant through the reversing valve 122 and to the indoor heat exchanger 108, where the refrigerant may transfer heat to an airflow that is passed through and/or into contact with the indoor heat exchanger 108 by the indoor fan 110. After exiting the indoor heat exchanger 108, the refrigerant may flow through and/or bypass the indoor metering device 112, such that refrigerant flow is not substantially restricted by the indoor metering device 112. Refrigerant generally exits the indoor metering device 112 and flows to the outdoor metering device 120, which may meter the flow of refrigerant through the outdoor metering device 120, such that the refrigerant downstream of the outdoor metering device 120 is at a lower pressure than the refrigerant upstream of the outdoor metering device 120. From the outdoor metering device 120, the refrigerant may enter the outdoor heat exchanger 114. As the refrigerant is passed through the outdoor heat exchanger 114, heat may be transferred to the refrigerant from an airflow that is passed through and/or into contact with the outdoor heat exchanger 114 by the outdoor fan 118. Refrigerant leaving the outdoor heat exchanger 114 may flow to the reversing valve 122, where the reversing valve 122 may be selectively configured to divert the refrigerant back to the compressor 116, where the refrigeration cycle may begin again.

Alternatively, to operate the HVAC system 100 in a so-called cooling mode, most generally, the roles of the indoor heat exchanger 108 and the outdoor heat exchanger 114 are reversed as compared to their operation in the above-described heating mode. For example, the reversing valve 122 may be controlled to alter the flow path of the refrigerant from the compressor 116 to the outdoor heat exchanger 114 first and then to the indoor heat exchanger 108, the indoor metering device 112 may be enabled, and the outdoor metering device 120 may be disabled and/or bypassed. In cooling mode, heat may generally be absorbed by refrigerant at the indoor heat exchanger 108 and rejected by the refrigerant at the outdoor heat exchanger 114. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. Additionally, as refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114.

Figure 2:
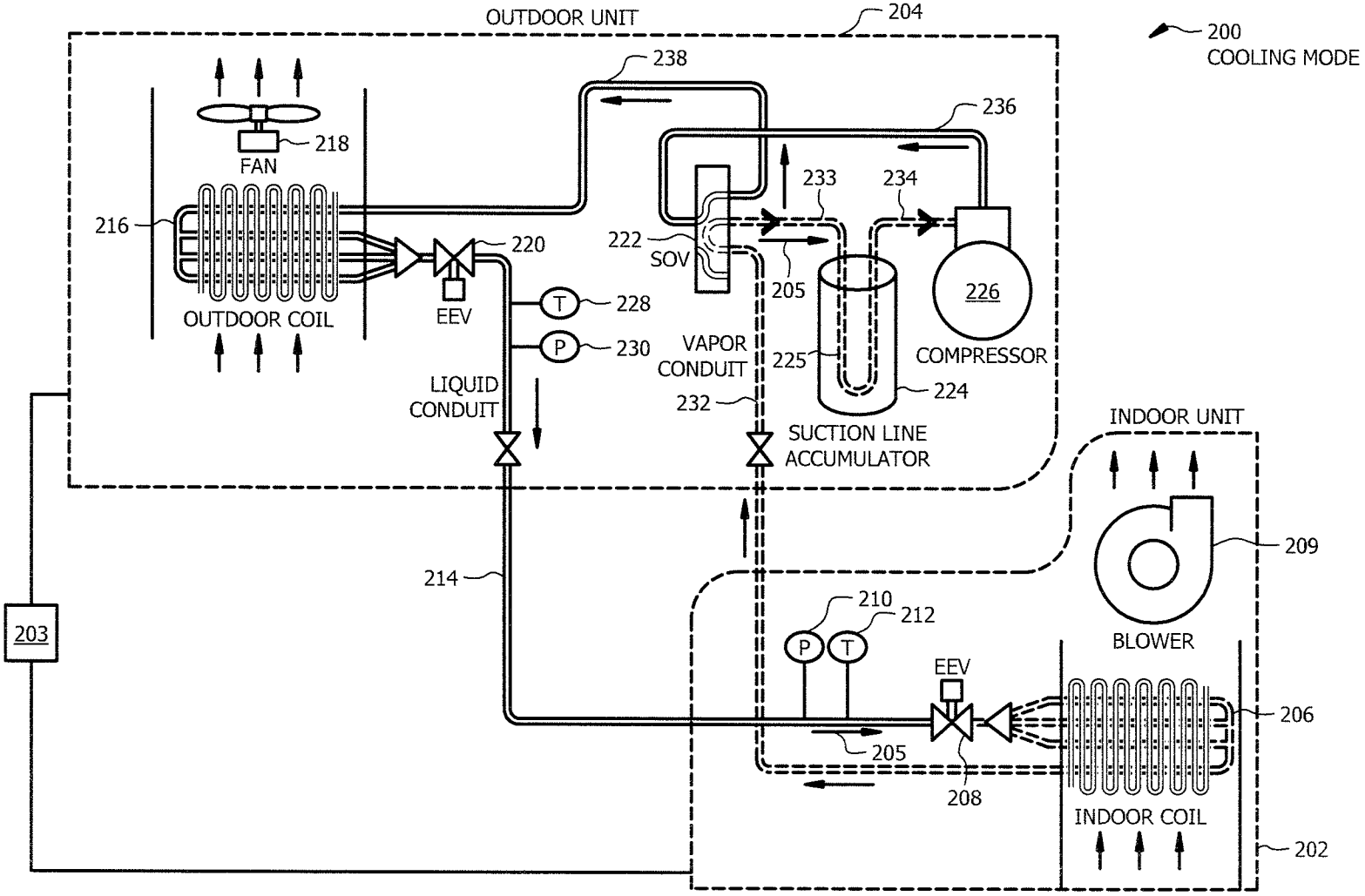
FIG. 2 illustrates an HVAC system operating in a cooling mode, in accordance with an embodiment of the disclosure.

Referring now to FIG. 2, a first embodiment of an HVAC system 200 operating in a cooling mode is shown, according to an embodiment of the disclosure. HVAC system 200 may be a particular implementation of HVAC system 100. HVAC system 200 may include components similar to those of HVAC system 100, and may operate similarly to HVAC system 100. HVAC system 200 may include a heat pump and/or an air conditioner. HVAC system 200 may include indoor unit 202 (shown by dashed lines) and outdoor unit 204 (shown by dashed lines). System controller 203 may control operation of HVAC system 200.

Indoor unit 202 may include indoor coil 206, EEV 208, blower 209, pressure sensor 210, and temperature sensor 212. EEV 208 may be positioned adjacent to indoor coil 206. EEV 208 may also be positioned between indoor coil 206, and pressure sensor 210 and temperature sensor 212, as shown. EEV 208 may fluidly couple indoor coil 206 to liquid conduit 214. Liquid conduit 214 may contain liquid refrigerant. Pressure sensor 210 and temperature sensor 212 may be fluidly coupled to liquid conduit 214 upstream of EEV 208.

During the cooling mode, EEV 208 controls the rate of liquid refrigerant or the amount of liquid refrigerant entering indoor coil 206 via liquid conduit 214, thereby controlling SC produced by outdoor coil 216. It should be noted that SC is a function of pressure and temperature of the refrigerant in liquid conduit 214. Therefore, a refrigerant flow rate controls the pressure and temperature. Indoor coil 206 is an evaporator coil in the cooling mode. Outdoor coil 216 is a condenser in the cooling mode.

Outdoor unit 204 may include outdoor coil 216, fan 218, EEV 220, switch over valve (SOV) 222, suction line accumulator 224, compressor 226, temperature sensor 228, and pressure sensor 230. Vapor conduit 232 may fluidly couple indoor coil 206 to SOV 222. SOV 222 may be fluidly coupled to suction line accumulator 224 via conduit 233. Suction line accumulator 224 may be fluidly coupled to compressor 226 via conduit 234. Suction line accumulator 224 may be a metal (e.g., steel) container and may accumulate refrigerant and may be sized to accommodate excess refrigerant depending on a valve setting of EEV 208.

Suction line accumulator 224 may include dip tube 225 that is configured to separate, with gravity, liquid refrigerant from vapor refrigerant, as will be understood by one having skill in the art. That is, gravity pulls the liquid refrigerant to the bottom of dip tube 225 and the vapor refrigerant flows to a top of dip tube 225 for suction into compressor 226. Suction line accumulator 224 is positioned upstream of compressor 226 and downstream of SOV 222 in order to facilitate passage of refrigerant from SOV 222 to compressor 226 regardless of a heating mode or a cooling mode setting for operation of HVAC system 200. In other words, the placement of suction line accumulator 224 allows suction line accumulator 224 to receive refrigerant from SOV 222 regardless of a flow direction of the refrigerant through HVAC system 200. SOV 222 reverses a circulation direction of refrigerant depending upon a cooling mode or a heating mode. The circulation direction of refrigerant in the cooling mode is opposite to the circulation direction of the refrigerant in the heating mode.

While working as an evaporator coil, indoor coil 206 may flood at times with excess refrigerant. In other words, during a cooling mode, system controller 203 receives pressure and temperature information from temperature sensor 212 and pressure sensor 210. These sensors are adjacent to indoor coil 206 and provide an accurate measurement of temperature and pressure of the refrigerant entering indoor coil 206, as compared to sensors positioned further upstream from indoor coil 206 (e.g., temperature sensor 228 and pressure sensor 230). Accurate pressure and temperature measurements allow for an accurate SC calculation, which allows for an efficient operation of HVAC system 200. Based on these pressure and temperature measurements, system controller 203 calculates an actual SC value of liquid refrigerant entering indoor coil 206, and compares it to a desired or specified SC value or threshold.

System controller 203 may be similar to system controller 106. System controller 203 may include inputs for selecting or adjusting a desired SC value, and a display for displaying a current SC value and the desired SC value. Also, system controller 203 may store information including various types of refrigerants, and their corresponding saturation temperatures at different pressures, or system controller 203 may have access to a database that stores this information (e.g., wireless or wired communication with the database). This information is readily available from pressure-temperature charts for different types of refrigerants, as will be understood by one having skill in the art.

For example, system controller 203 may calculate the SC by first receiving the temperature and pressure measurements from the sensors. Then, system controller 203 determines or looks up a corresponding saturation temperature for the measured pressure based on the pressure-temperature information or chart. Then, system controller 203 subtracts the measured temperature (liquid conduit temperature) from the corresponding saturation temperature to calculate the SC. Table 1 illustrates measured pressures and corresponding saturation temperatures for a refrigerant utilized in HVAC systems, R-410A, for example.

TABLE 1

Measured Pressures and Corresponding Saturation Temperatures for R-410A.

| Measured Pressure (pounds per square inch gauge, PSIG) | Saturation Temperature (° F.) |
|---|---|
| 12 | −38 |
| 48 | 0 |
| 80 | 21 |
| 160 | 56 |
| 320 | 101 |

If the calculated SC is below the threshold, EEV 208 modulates (e.g., closes partially or completely) to intentionally back up, flood, or hold refrigerant upstream of EEV 208 and in outdoor coil 216. This holding of refrigerant in outdoor coil 216 increases SC, as calculated from the temperature and pressure measurements.

If the calculated SC is above the threshold, then EEV 208 modulates (e.g., opens partially or completely) to drain a backed up or flooded outdoor coil 216 to reduce SC, as calculated from the temperature and pressure measurements. Upon reaching the desired threshold SC, EEV 208 ceases to modulate and remains in a fixed position to maintain the desired SC. That is, system controller 203 is configured to control SC by monitoring, periodically or continuously, temperature and pressure measurements from temperature sensor 212 and pressure sensor 210, and modulate EEV 208 until the threshold for SC is satisfied. Any excess refrigerant that was backed up upstream of EEV 208 flows into suction line accumulator 224, upon opening of EEV 208.

Upon reaching the desired threshold SC, EEV 208 ceases to modulate and remains in a fixed position to maintain the desired SC. That is, system controller 203 may be configured to maintain EEV 208 in a fixed position to maintain the desired SC. This process of determining, and adjusting or maintaining the SC may repeat as needed to achieve a desired SC.

Depending on ambient conditions (e.g., outdoor or indoor conditions), SC may be adjusted or maintained. For example, with typical superheat control, an amount of SC tends to increase as outdoor ambient temperatures vary from 120° F. down to 55° F. at fixed indoor ambient conditions. This tends to reduce system efficiency (e.g., Coefficient of Performance, (COP)).

Figure 6:
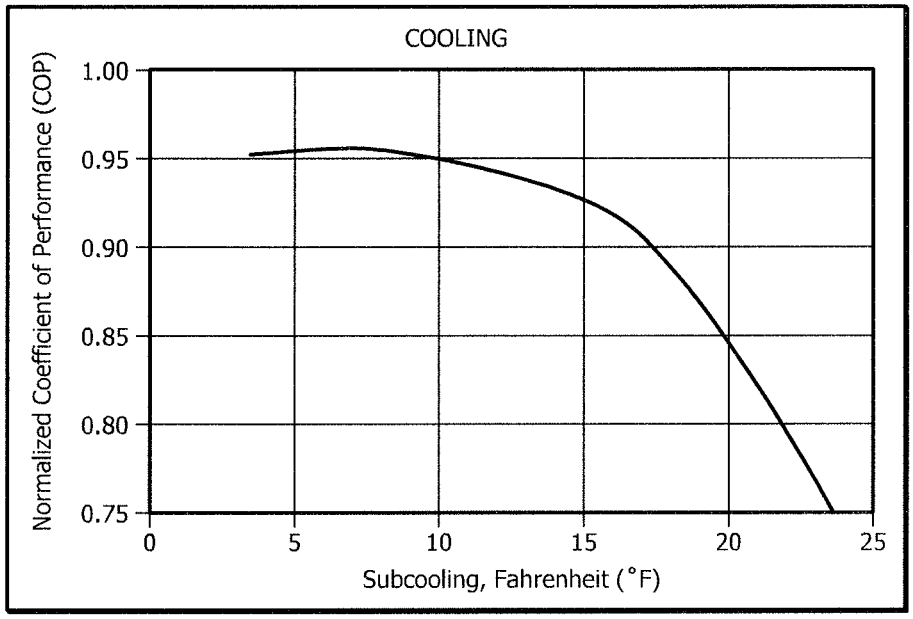
FIG. 6 is a graph illustrating a normalized coefficient of performance as a function of subcooling during operation of an HVAC system in a cooling mode, in accordance with an embodiment of the disclosure.

As shown on FIG. 6, during a cooling mode, a normalized COP decreases as SC increases. With subcooling control, system controller 203 adjusts or maintains SC to optimize system efficiency of HVAC system 200.

As an outdoor (OD) ambient temperature decreases from 95° F., for example, a measured SC increases, thereby reducing system efficiency. To maintain efficiency, system controller 203 reduces SC by opening EEV 208 to drain backed up refrigerant from outdoor coil 216. Draining the backed up refrigerant leads to lower superheat leaving indoor coil 206 and potentially some excess liquid refrigerant. The excess liquid refrigerant would then flow into suction line accumulator 224. This liquid refrigerant is sequestered in suction line accumulator 224 and is thus removed from circulation, thereby reducing SC.

Suction line accumulator 224 allows refrigerant to be added to circulating refrigerant or removed from circulating refrigerant, thereby controlling SC produced by HVAC system 200. A larger volume of liquid refrigerant in suction line accumulator 224 corresponds with a lower SC, due to a decrease in circulating refrigerant. A smaller volume of liquid refrigerant in suction line accumulator 224 corresponds with a higher SC, due to an increase in circulating refrigerant. Suction line accumulator 224 is sized to capture the excess refrigerant and prevent too much refrigerant from entering compressor 226. Discharge conduit 236 may fluidly couple compressor 226 to SOV 222.

SOV 222 may be fluidly coupled to outdoor coil 216 via conduit 238. SOV 222 may be a reversing valve that controls the direction of the flow of refrigerant through HVAC system 200, depending on a heating mode setting or a cooling mode setting of system controller 203.

EEV 220 may be adjacent to outdoor coil 216. EEV 220 may also be positioned between outdoor coil 216 and temperature sensor 228 and pressure sensor 230, as shown. Liquid conduit 214 may extend from EEV 220 to EEV 208, thereby fluidly coupling EEV 220 (e.g., a second EEV) to EEV 208 (e.g., a first EEV). Also, EEV 220 may fluidly couple liquid conduit 214 to outdoor coil 216. During the cooling mode, EEV 220 is fully open and remains fully open. This configuration of EEV 208 and EEV 220 maintains liquid refrigerant in liquid conduit 214 during modulation of EEV 208. That is, as EEV 208 opens or closes, the liquid refrigerant remains upstream of EEV 208 in liquid conduit 214. This configuration of EEVs 220 and 208 minimizes or prevents flashing of gas in liquid conduit 214. Flash gas in liquid conduit 214 may be detrimental to the efficiency of the refrigeration cycle of HVAC system 200, as will be understood by one having skill in the art.

Figure 3:
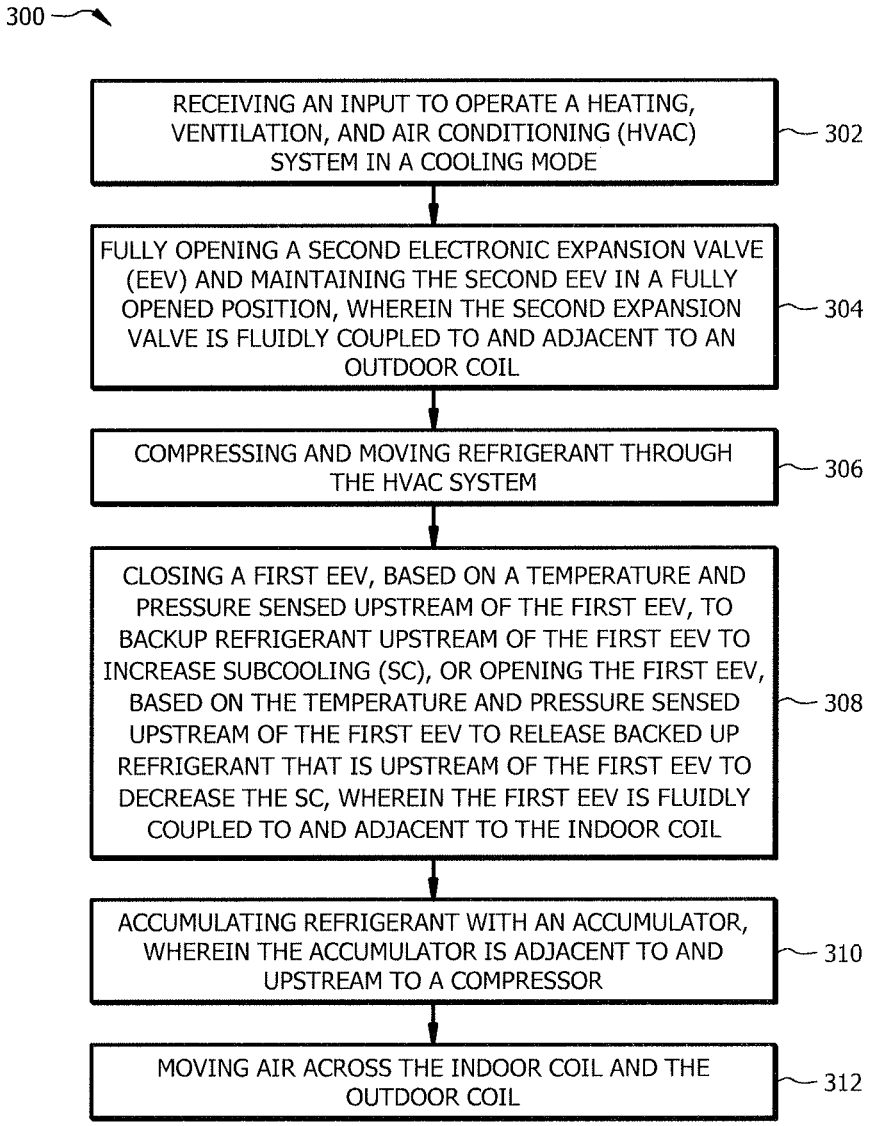
FIG. 3 is a flow chart illustrating operational steps of an HVAC system in the cooling mode, in accordance with an embodiment of the disclosure.

An example operation of HVAC system 200 in the cooling mode is shown on flow chart 300 of FIG. 3. At step 302, system controller 203 receives an input to operate in a cooling mode. At step 304, system controller 203 fully opens EEV 220 and maintains EEV 220 in a fully opened position. At step 306, system controller 203 directs compressor 226 to compress and move refrigerant through HVAC system 200 as indicated by arrows 205.

At step 308, system controller 203 directs EEV 208 to close completely or close partially, based on temperature and pressure sensed with pressure sensor 210 and temperature sensor 212, to restrict refrigerant flow and back up the refrigerant upstream of EEV 208 and in outdoor coil 216 to increase SC, or system controller 203 opens EEV 208, based on temperature and pressure sensed with pressure sensor 210 and temperature sensor 212, to release backed up refrigerant that is upstream of EEV 208 and in outdoor coil 216 to decrease SC.

At step 310, suction line accumulator 224 accumulates any excess refrigerant captured from indoor coil 206. Indoor coil 206 may be operating such that no superheat (SH) is leaving indoor coil 206 thereby causing indoor coil 206 to flood with excess refrigerant. Suction line accumulator 224 captures, stores, and prevents an excess amount of refrigerant leaving indoor coil 206 from entering compressor 226, which may prevent damage to compressor 226. At step 312, system controller 203 directs fan 218 and blower 209 to move air across outdoor coil 216 and indoor coil 206, respectively.

Figure 4:
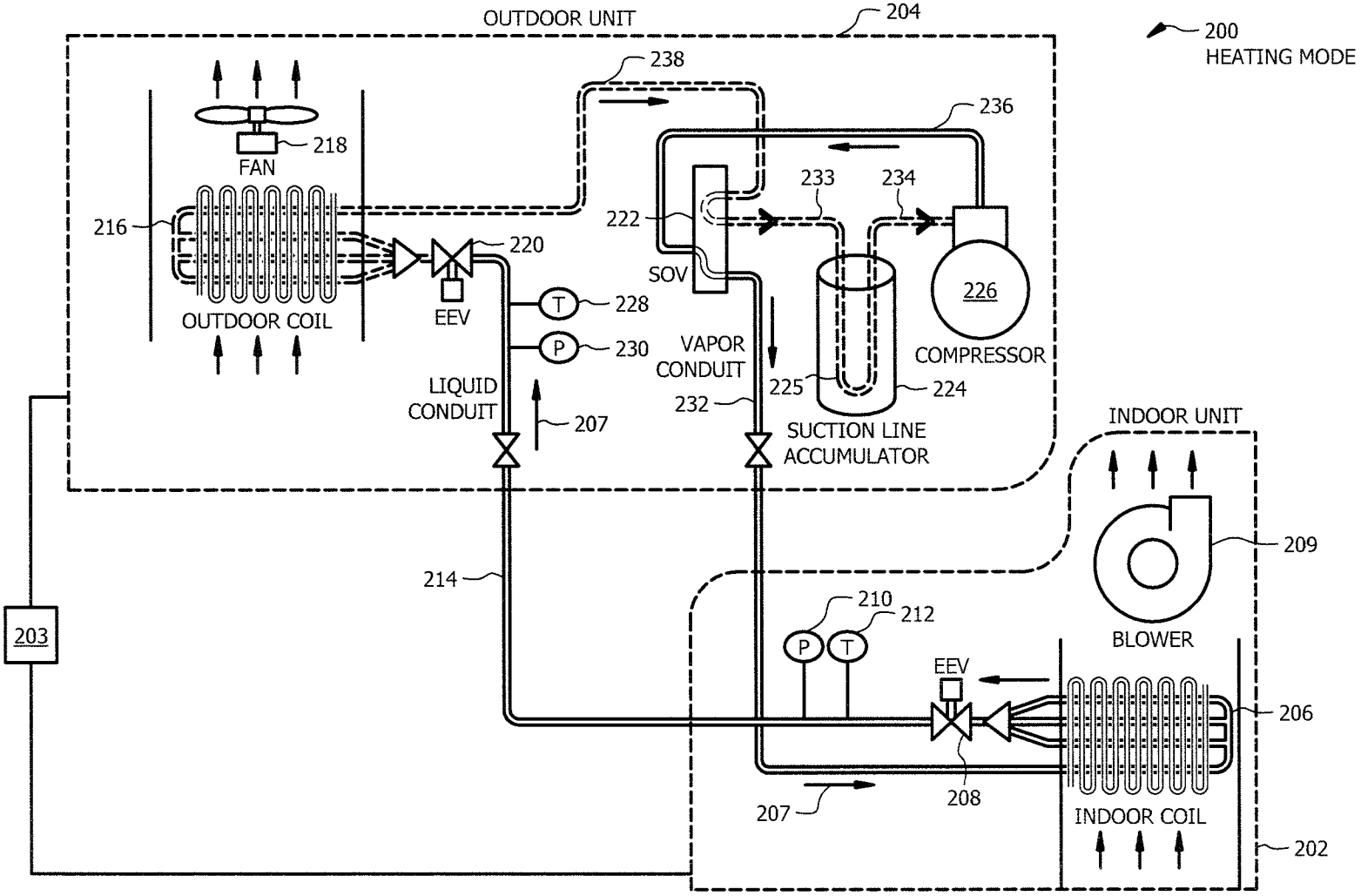
FIG. 4 illustrates an HVAC system operating in a heating mode, in accordance with an embodiment of the disclosure.

FIG. 4 illustrates an HVAC system 200 operating in a heating mode. In this embodiment HVAC system 200 may include a heat pump. HVAC system 200 may include indoor unit 202 (shown by dashed lines) and outdoor unit 204 (shown by dashed lines). System controller 203 may control operation of HVAC system 200.

Indoor unit 202 may include indoor coil 206, EEV 208, blower 209, pressure sensor 210, and temperature sensor 212. EEV 208 may be adjacent to indoor coil 206. EEV 208 may also be positioned between indoor coil 206, and pressure sensor 210 and temperature sensor 212, as shown. EEV 208 may fluidly couple indoor coil 206 to liquid conduit 214. Pressure sensor 210 and temperature sensor 212 may be fluidly coupled to liquid conduit 214 downstream of EEV 208.

During the heating mode, EEV 208 is fully open and remains fully open. This configuration of EEV 208 and EEV 220 maintains liquid refrigerant in liquid conduit 214 during modulation of EEV 220. That is, as EEV 220 opens or closes, the liquid refrigerant remains upstream of EEV 220 in liquid conduit 214. This configuration of EEVs 220 and 208 minimizes or prevents flashing of gas in liquid conduit 214. Flash gas in liquid conduit 214 may be detrimental to the efficiency of the refrigeration cycle of HVAC system 200, as will be understood by one having skill in the art.

EEV 220 controls the rate or an amount of liquid refrigerant entering outdoor coil 216 via liquid conduit 214, thereby controlling SC produced by indoor coil 206. As previously mentioned, SC is a function of pressure and temperature of the refrigerant in liquid conduit 214. Outdoor coil 216 is an evaporator in the heating mode. Indoor coil 206 is a condenser in the heating mode.

Outdoor unit 204 may include outdoor coil 216, fan 218, EEV 220, SOV 222, suction line accumulator 224, compressor 226, temperature sensor 228, and pressure sensor 230. Vapor conduit 232 may fluidly couple indoor coil 206 to SOV 222. SOV 222 may be fluidly coupled to suction line accumulator 224 via conduit 233.

Suction line accumulator 224 may be fluidly coupled to compressor 226 via conduit 234. Suction line accumulator 224 may be a metal container and may accumulate refrigerant. Suction line accumulator 224 may be sized to accommodate excess refrigerant depending on a valve setting of EEV 220. Outdoor coil 216, while working as an evaporator coil, may flood at times with excess refrigerant.

During a heating mode, system controller 203 receives pressure and temperature information from temperature sensor 228 and pressure sensor 230. These sensors are adjacent to outdoor coil 216 and provide a more accurate measurement of temperature and pressure of the refrigerant entering outdoor coil 216, as compared to sensors positioned further upstream from outdoor coil 216 (e.g., temperature sensor 212 and pressure sensor 210). Based on these measurements, system controller 203 calculates an actual SC value and compares it to a desired or specified SC value or threshold.

If the calculated SC is below the threshold, EEV 220 closes completely or partially to restrict refrigerant flow and to intentionally back up, flood, or hold refrigerant upstream of EEV 220 and in indoor coil 206. This holding of refrigerant in indoor coil 206 increases SC, as calculated from the temperature and pressure measurements.

If the calculated SC is above the threshold, then EEV 220 opens completely or partially to drain a backed up or flooded indoor coil 206 to reduce SC, as calculated from the temperature and pressure measurements. Any excess refrigerant that was backed up upstream of EEV 220 flows or drains into suction line accumulator 224, upon opening of EEV 220.

Upon reaching the desired threshold SC, EEV 220 ceases to modulate and remains in a fixed position to maintain the desired SC. This process of determining, and adjusting or maintaining the SC may repeat as needed to achieve a desired SC. That is, system controller 203 is configured to control SC by monitoring, periodically or continuously, temperature and pressure measurements from temperature sensor 228 and pressure sensor 230, and modulate EEV 220 until the threshold for SC is satisfied.

Outdoor coil 216 may have an internal volume larger than an internal volume of indoor coil 206. Typically, HVAC system 200 may be charged with refrigerant for the cooling mode. When the mode is switched to heating, the SC is more than desired since coil internal volume of outdoor coil 216 is larger than the coil internal volume of indoor coil 206. That is, in the cooling mode, outdoor coil 216 is a condenser and thus has most of the refrigerant charge. When the mode is switched to heating, indoor coil 206 becomes the condenser and most of the charge moves to indoor coil 206. This causes flooding of indoor coil 206 when EEV 220 is closed (completely closed or partially closed) because the volume of charge is larger than the capacity of the internal volume of indoor coil 206. Any excess charge that has been backed up upstream of EEV 220 and in indoor coil 206, due to a closure of EEV 220, flows or drains into suction line accumulator 224, upon opening of EEV 220.

Fluctuations in outdoor ambient conditions also impact SC during the heating mode. As an outdoor (OD) ambient temperature decreases 50° F. to 10° F., for example, a measured SC increases, thereby reducing system efficiency. To maintain efficiency, system controller 203 reduces SC by opening EEV 220 to drain backed up refrigerant in indoor coil 206. This would lead to lower superheat leaving outdoor coil 216 and potentially some excess liquid refrigerant. The excess liquid refrigerant would then flow into suction line accumulator 224. This liquid refrigerant is sequestered in suction line accumulator 224 and is thus removed from circulation, thereby reducing SC.

Figure 7:
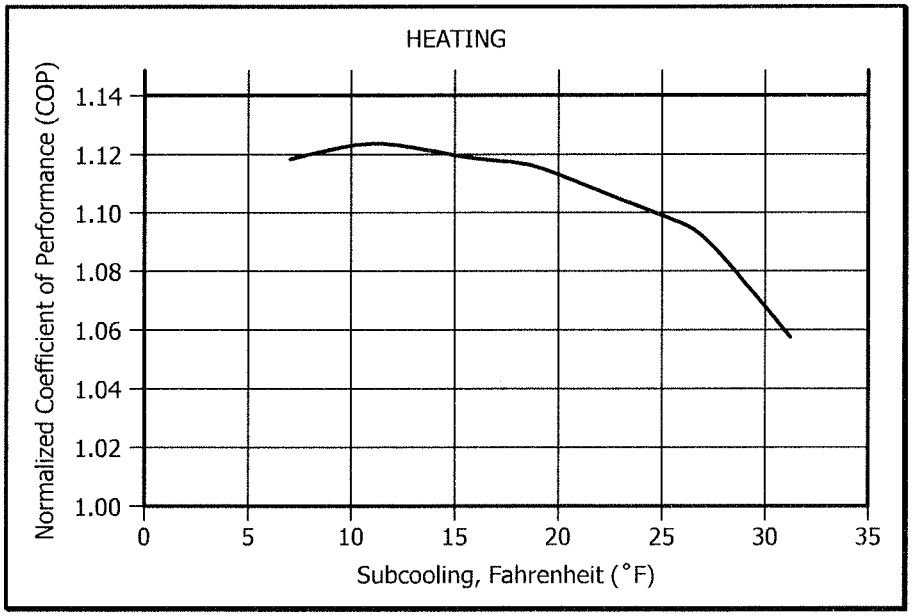
FIG. 7 is a graph illustrating a normalized coefficient of performance as a function of subcooling during operation of an HVAC system in a heating mode, in accordance with an embodiment of the disclosure.

As shown on FIG. 7, during the heating mode, a normalized COP decreases as SC increases. With subcooling control, system controller 203 adjusts or maintains SC to optimize system efficiency.

Suction line accumulator 224 is sized to capture the excess refrigerant leaving outdoor coil 216, and prevent too much refrigerant from entering compressor 226. Discharge conduit 236 may fluidly couple compressor 226 to SOV 222.

SOV 222 may be fluidly coupled to outdoor coil 216 via conduit 238. SOV 222 controls the direction of the flow of refrigerant through HVAC system 200, depending on a heating mode setting or a cooling mode setting of system controller 203. In the heating mode, the flow of refrigerant will flow in an opposite direction, as compared to the cooling mode. EEV 220 may be positioned between outdoor coil 216, and temperature sensor 228 and pressure sensor 230, as shown. Liquid conduit 214 may extend from EEV 220 to EEV 208 thereby fluidly coupling EEV 220 to EEV 208. Also, EEV 220 may fluidly couple liquid conduit 214 to outdoor coil 216.

Figure 5:
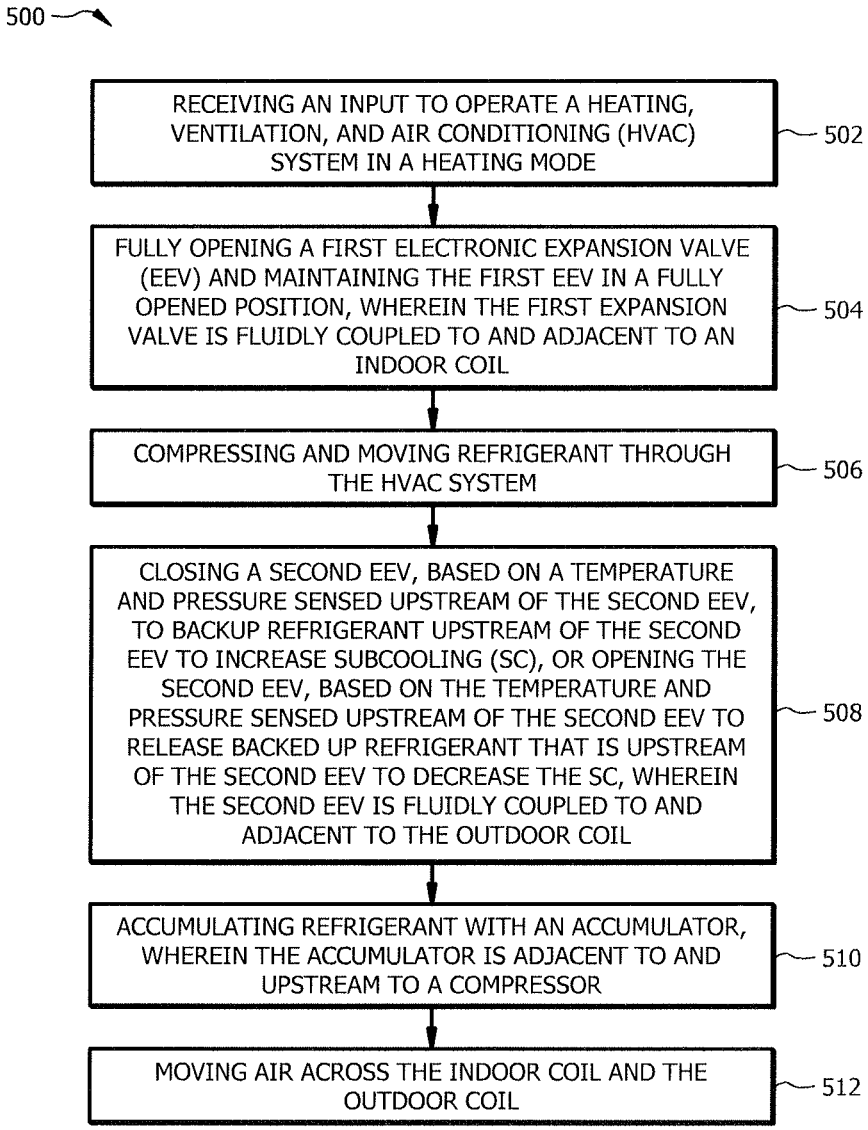
FIG. 5 is a flow chart illustrating operational steps of an HVAC system in the heating mode, in accordance with an embodiment of the disclosure.

An example operation of HVAC system 200 in a heating mode is shown in flow chart 500 of FIG. 5. At step 502, system controller 203 receives an input to operate in a heating mode. At step 504, system controller 203 fully opens EEV 208 and maintains EEV 208 in a fully opened position. At step 506, system controller 203 directs compressor 226 to compress and move refrigerant through HVAC system 200 as indicated by arrows 207.

At step 508, system controller 203 directs EEV 220 to close completely or partially, based on temperature and pressure sensed with pressure sensor 230 and temperature sensor 228, to restrict refrigerant flow and back up the refrigerant upstream of EEV 220 and in indoor coil 206 to increase SC. Alternatively, system controller 203 opens EEV 208 completely or partially, based on temperature and pressure sensed with pressure sensor 230 and temperature sensor 228, to release backed up refrigerant that is upstream of EEV 220 and in indoor coil 206 to decrease SC.

At step 510, suction line accumulator 224 accumulates any excess refrigerant captured from outdoor coil 216. Outdoor coil 216 may be operating such that no SH is leaving outdoor coil 216 thereby causing outdoor coil 216 to flood with excess refrigerant. Suction line accumulator 224 captures, stores, and prevents an excess amount of the refrigerant leaving outdoor coil 216 from entering compressor 226, which may prevent damage to compressor 226. At step 512, system controller 203 directs fan 218 and blower 209 to move air across outdoor coil 216 and indoor coil 206, respectively.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and air conditioning (HVAC) system comprising:

an outdoor coil;

an indoor coil;

a switch over valve (SOV) that is in fluid communication with the indoor and outdoor coils, wherein the SOV directs a flow of refrigerant in a first direction during a cooling mode, and directs the flow of refrigerant in a second direction during a heating mode, wherein the first direction is opposite to the second direction;

a first electronic expansion valve (EEV) fluidly coupled to the indoor coil, wherein the first EEV is adjacent to the indoor coil;

a second EEV fluidly coupled to the outdoor coil, wherein the second EEV is adjacent to the outdoor coil;

a liquid conduit fluidly coupling the first and second EEVs;

a first set of pressure and temperature sensors in fluid communication with the liquid conduit, wherein the first set of pressure and temperature sensors are adjacent to the first EEV and upstream of the first EEV during the cooling mode;

a second set of pressure and temperature sensors in fluid communication with the liquid conduit, wherein the second set of pressure and temperature sensors are adjacent to the second EEV and upstream of the second EEV during the heating mode; and a system controller configured to control the first and second EEVs to control the flow of refrigerant to control subcooling (SC) produced by the HVAC system based on temperature and pressure measurements, wherein the second EEV remains open during the cooling mode, and wherein the first EEV modulates during the cooling mode based on temperatures and pressures measured by the first set of pressure and temperature sensors; and wherein the first EEV is configured to restrict refrigerant flow, during the cooling mode, to back up the refrigerant that is upstream of the first EEV and in the outdoor coil, thereby increasing the SC.

2. The HVAC system of claim 1, wherein the first EEV is configured to remain in a closed position until pressure and temperature measurements taken at the first set of pressure and temperature sensors indicate to the system controller that a SC threshold is satisfied, wherein the SC produced by the HVAC system is based on pressure and temperature measurements taken at the first set of pressure and temperature sensors during the cooling mode.

3. The HVAC system of claim 2, wherein the first EEV is configured to open, during the cooling mode, to release backed up refrigerant that is upstream of the first EEV and in the outdoor coil, thereby decreasing the SC to satisfy the SC threshold.

4. The HVAC system of claim 1, further comprising:

a compressor in fluid communication with the indoor and outdoor coils; and a suction line accumulator adjacent to the compressor and in fluid communication with the compressor, wherein the suction line accumulator is upstream of the compressor.

5. The HVAC system of claim 4, wherein the suction line accumulator is configured to receive excess refrigerant from the indoor coil during the cooling mode and is configured to receive excess refrigerant from the outdoor coil during the heating mode.

6. The HVAC system of claim 5, wherein the suction line accumulator is configured to prevent the excess refrigerant from entering the compressor during the cooling and heating modes.

7. The HVAC system of claim 1, wherein the first EEV remains open during the heating mode, and wherein the second EEV modulates during the heating mode based on temperatures and pressures measured by the second set of pressure and temperature sensors; and wherein the second EEV is configured to restrict refrigerant flow, during the heating mode, to back up the refrigerant that is upstream of the second EEV and in the indoor coil, thereby increasing the SC, wherein a direction of the flow of the refrigerant through the liquid conduit, in the heating mode, is opposite to the flow of refrigerant in the cooling mode.

8. The HVAC system of claim 7, wherein the second EEV is configured to remain in a closed position until pressure and temperature measurements at the second set of pressure and temperature sensors indicate to the system controller that a SC threshold is satisfied, wherein the SC produced by the HVAC system is based on pressure and temperature measurements taken at the first set of pressure and temperature sensors during the heating mode.

9. The HVAC system of claim 8, wherein the second EEV is configured to open, during the heating mode, to release backed up refrigerant that is upstream of the second EEV and in the indoor coil, thereby decreasing the SC to satisfy the SC threshold.

10. A heating, ventilation, and air conditioning (HVAC) system comprising:

an outdoor coil;

an indoor coil;

a switch over valve (SOV) in fluid communication with the indoor and outdoor coils, wherein the SOV directs a flow of refrigerant in a first direction during a cooling mode, and directs the flow of refrigerant in a second direction during a heating mode, wherein the first direction is opposite to the second direction;

a first electronic expansion valve (EEV) fluidly coupled to the indoor coil, wherein the first EEV is adjacent to the indoor coil;

a first set of pressure and temperature sensors, wherein the first set of pressure and temperature sensors are adjacent to the first EEV and upstream to the first EEV during the cooling mode and downstream to the first EEV during the heating mode;

a second EEV fluidly coupled to the outdoor coil, wherein the second EEV is adjacent to the outdoor coil;

a liquid conduit fluidly coupling the first and second EEVs and in fluid communication with the first set of pressure and temperature sensors;

a compressor in fluid communication with the indoor and outdoor coils;

a suction line accumulator adjacent to the compressor and in fluid communication with the compressor, wherein the suction line accumulator is upstream of the compressor, wherein the suction line accumulator is configured to receive excess refrigerant from the indoor coil during the cooling mode and is configured to receive excess refrigerant from the outdoor coil during the heating mode; and a system controller configured to control the first and second EEVs to control the flow of refrigerant to control subcooling (SC) produced by the HVAC system, wherein the second EEV remains open during the cooling mode, and wherein the first EEV modulates during the cooling mode; and wherein the first EEV is configured to restrict refrigerant flow, based on pressure and temperature measurements from the first set of pressure and temperature sensors, to back up the refrigerant that is upstream of the first EEV and in the outdoor coil, thereby increasing the SC during the cooling mode.

11. The HVAC system of claim 10, further comprising a second set of pressure and temperature sensors in fluid communication with the liquid conduit, wherein the second set of pressure and temperature sensors are adjacent to the second EEV and upstream to the second EEV during the heating mode and downstream to the second EEV during the cooling mode.

12. The HVAC system of claim 11, wherein the second EEV is configured to restrict refrigerant flow, based on pressure and temperature measurements from the second set of pressure and temperature sensors, to back up the refrigerant that is upstream of the second EEV and in the indoor coil, thereby increasing the SC during the heating mode, wherein a direction of the flow of the refrigerant through the liquid conduit, in the heating mode, is opposite to the flow of refrigerant in the cooling mode.

13. The HVAC system of claim 12, wherein the first EEV remains open during the heating mode, and wherein the second EEV modulates during the heating mode; and wherein the second EEV is configured to remain in a closed position until pressure and temperature measurements at the second set of pressure and temperature sensors indicate to the system controller that a SC threshold is satisfied during the heating mode.

14. The HVAC system of claim 13, wherein the second EEV is configured to open to release backed up refrigerant that is upstream of the second EEV and in the indoor coil, thereby decreasing the SC to satisfy the SC threshold during the heating mode.

15. The HVAC system of claim 10, wherein the first EEV is configured to remain in a closed position until the pressure and temperature measurements taken at the first set of pressure and temperature sensors indicate to the system controller that a SC threshold is satisfied during the cooling mode.

16. The HVAC system of claim 15, wherein the first EEV is configured to open to release backed up refrigerant that is upstream of the first EEV and in the outdoor coil, thereby decreasing the SC to satisfy the SC threshold during the cooling mode.

17. The HVAC system of claim 10, wherein the suction line accumulator is configured to prevent the excess refrigerant from entering the compressor during the cooling and heating modes.

* * * * *